US010794174B2

(12) United States Patent
Lu et al.

(10) Patent No.: US 10,794,174 B2
(45) Date of Patent: Oct. 6, 2020

(54) DYNAMICALLY SELF-BALANCING PRESSURIZED BOREHOLE-SEALING APPARATUS AND METHOD THEREOF FOR COAL SEAM GAS PRESSURE MEASUREMENT

(71) Applicant: SHANDONG UNIVERSITY OF SCIENCE AND TECHNOLOGY, Qingdao (CN)

(72) Inventors: Wei Lu, Qingdao (CN); Zhen Liu, Qingdao (CN); Guansheng Qi, Qingdao (CN); Jinliang Li, Qingdao (CN); Dongling Sun, Qingdao (CN); Weimin Cheng, Qingdao (CN); Dong Wang, Qingdao (CN); Chuanrui Qin, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 18 days.

(21) Appl. No.: 16/475,606

(22) PCT Filed: Jul. 13, 2018

(86) PCT No.: PCT/CN2018/095701
§ 371 (c)(1),
(2) Date: Jul. 2, 2019

(87) PCT Pub. No.: WO2019/100732
PCT Pub. Date: May 31, 2019

(65) Prior Publication Data

US 2019/0323340 A1 Oct. 24, 2019

(30) Foreign Application Priority Data

Nov. 24, 2017 (CN) ..... 2017 1 1221627

(51) Int. Cl.
*E21B 47/06* (2012.01)
*E21F 17/00* (2006.01)
(Continued)

(52) U.S. Cl.
CPC ..... *E21B 47/06* (2013.01); *E21B 33/1246* (2013.01); *E21B 33/13* (2013.01); *E21F 17/00* (2013.01)

(58) Field of Classification Search
CPC ..... E21B 47/06; E21B 33/127–1277; E21F 7/00; E21F 17/00
See application file for complete search history.

(56) References Cited

U.S. PATENT DOCUMENTS 3,845,632 A * 11/1974 Slobod ..... C09K 17/12 405/266
3,948,055 A * 4/1976 Choi ..... C09K 17/02 405/263
(Continued)

FOREIGN PATENT DOCUMENTS

CN 85106104 A * 3/1987
CN 201671653 U * 12/2010
(Continued)

OTHER PUBLICATIONS

Machine Translation CN102003173 (Year: 2020).*
(Continued)

*Primary Examiner* — David L Singer
(74) *Attorney, Agent, or Firm* — Hauptman Ham, LLP

(57) ABSTRACT

A dynamically self-balancing pressurized borehole sealing apparatus and method thereof for coal seam gas pressure measurement having a pressure measuring tube arranged in a borehole with one end of the pressure measuring tube provided with a pressure measuring unit. The pressure measuring tube is wrapped with an expansion airbag and
(Continued)

provided with a pressure introducing hole communicating with the expansion airbag. On each side of the expansion airbag, the pressure measuring tube is wrapped with a front borehole inflatable sealing airbag and a rear borehole inflatable sealing airbag respectively. A gel injection chamber is reserved between the front borehole sealing airbag and the rear borehole sealing airbag and between the expansion airbag and an inner side of the borehole. Gas from the pressure measuring tube expands the expansion airbag and squeezes sealing gel in the gel injection chamber into borehole fractures for dynamic pressurized sealing.

10 Claims, 2 Drawing Sheets

(51) Int. Cl.
*E21B 33/124* (2006.01)
*E21B 33/13* (2006.01)

(56) References Cited

U.S. PATENT DOCUMENTS 4,009,578 A * 3/1977 Choi ..... E21F 5/18 405/263
4,829,902 A * 5/1989 Sharpe ..... F42D 1/10 102/312
4,988,238 A * 1/1991 Szekely ..... C09K 17/12 166/292
2016/0160595 A1* 6/2016 Randall ..... E21B 7/061 166/298

FOREIGN PATENT DOCUMENTS

CN 201687466 U * 12/2010
CN 102003173 A * 4/2011
CN 201851112 U * 6/2011
CN 102562126 A * 7/2012
CN 202417567 U * 9/2012
CN 102889958 A * 1/2013
CN 202869731 U * 4/2013
CN 104343415 A * 2/2015
CN 204186376 U * 3/2015
CN 104533336 A * 4/2015
CN 204729086 U * 10/2015
CN 105134129 A * 12/2015
CN 204899914 U * 12/2015
CN 205012965 U * 2/2016
CN 105756599 A * 7/2016
CN 105927214 A * 9/2016
CN 205876263 U * 1/2017
CN 108060903 A 5/2018
WO 2019100732 A1 5/2019

OTHER PUBLICATIONS

Machine Translation CN102889958 (Year: 2020).*
Machine Translation CN104533336A (Year: 2020).*
Machine Translation CN105756599A (Year: 2020).*
Machine Translation CN204186376U (Year: 2020).*
Machine Translation CN204729086U (Year: 2020).*
Machine Translation CN204899914U (Year: 2020).*
Machine Translation CN205876263U (Year: 2020).*
Schlumberger, Oilfield Glossary: gel (Year: 2016).*
Gray, Reservoir Engineering in Coal Seams: Part 2—Observations of Gas Movement in Coal Seams, SPE Reservoir Engineering, Feb. 1987 (Year: 1987).*
Wong et al, The potential of superabsorbent polymer for self-sealing cracks in concrete, Article in Advances in Applied Ceramics • Jan. 2010 (Year: 2010).*
Helmenstine, What Is Water Glass? Water Glass or Sodium Silicate Facts, Science Notes and Projects (Year: 2017).*
International Search Report (Form PCT/ISA/210) dated Oct. 12, 2018 issued in corresponding International Application No. PCT/CN2018/095701.
Written Opinion of the International Search Authority (Form PCT/ISA/237) dated Oct. 12, 2018 issued in corresponding International Application No. PCT/CN2018/095701.
Chinese Search Report dated Sep. 12, 2018 issued in corresponding Chinese Application No. 201711221627X.
First Office Action dated Sep. 29, 2018 issued in corresponding Chinese Application No. 201711221627X.

* cited by examiner

DYNAMICALLY SELF-BALANCING PRESSURIZED BOREHOLE-SEALING APPARATUS AND METHOD THEREOF FOR COAL SEAM GAS PRESSURE MEASUREMENT

RELATED APPLICATIONS

The present application is a National Phase of International Application Number PCT/CN2018/095701, filed Jul. 13, 2018, which claims priority to Chinese Patent Application No. 201711221627.X, filed Nov. 24, 2017.

TECHNICAL FIELD

The present disclosure relates to the field of coal seam gas pressure measuring technology and in particular to a dynamically self-balancing pressurized borehole sealing apparatus and a method thereof for coal seam gas pressure measurement.

BACKGROUND

In recent years, with increasing mining depths of coal mines and increasing coal seam gas pressures, the coal seam gas pressure, as one of the most important coal seam gas parameters, plays a core directing role in mine disaster grading, gas emission rate prediction and gas outburst control and so on and is regarded as one key determining parameter. The accuracy of measuring the coal seam gas pressure is directly related to mine designing, construction and safe production. Thus, performing coal seam gas pressure measurement before coal seam mining and during a mining process has become an indispensable key link for ensuring safe production of a mine. At the same time, Stipulations for Preventing and Controlling Outbursts of Coal and Gas states that borehole sealing must be tight. However, at present, when a driller performs borehole sealing for gas measurement, borehole sealing is performed with solid (including a cement-based solid and a polyurethane solid and so on) according to a traditional borehole sealing method. The borehole sealing may be performed by methods or approaches of sealing liquid with solid and sealing gas with liquid and so on and the sealing may also be performed by pressurizing a borehole sealing gel body with a fixed pressure. The above two borehole sealing manners both are a static borehole sealing manner. In this manner, a new fracture may be formed in a borehole during a measuring process due to different stresses and effects of physical and chemical changes of a coal itself, resulting in pressure leakage due to untight sealing of the borehole. In this case, the measured gas pressures may be more or less lower than an actual coal seam gas pressure, resulting in wrong determinations of a gas pressure and a gas occurrence amount, causing significant potential gas hazards and accidents, and posing significant threat to safe production and life safety.

SUMMARY

The subject of the present disclosure is to provide a dynamically self-balancing pressurized borehole sealing apparatus and a method thereof for coal seam gas pressure measurement to solve a problem of inaccurate gas pressure measurement caused by a bad coal seam borehole sealing effect used for coal seam gas pressure measurement at present.

According to an example of the present disclosure, there is provided a dynamically self-balancing pressurized borehole sealing apparatus for coal seam gas pressure measurement, including a pressure measuring tube arranged in a borehole, where one end of the pressure measuring tube is provided with a pressure measuring unit for measuring a gas pressure, an expansion airbag is surrounded and wrapped on the pressure measuring tube, a pressure introducing hole is arranged on the pressure measuring tube and communicates with the expansion airbag, both sides of the expansion airbag on the pressure measuring tube are surrounded and wrapped by a front borehole sealing airbag and a rear borehole sealing airbag respectively, a gel injection chamber is reserved between the three of the front borehole sealing airbag, the rear borehole sealing airbag, the expansion airbag and an inner wall of the borehole, and filled with a sealing gel body, the front borehole sealing airbag and the rear borehole sealing airbag both are connected to an inflating unit outside the borehole through an inflating pipe, and the gel injection chamber is connected to a gel injecting unit outside the borehole through a gel injection pipe.

Further, an annular baffle surrounding the pressure measuring tube is arranged on a side that is on the front borehole sealing airbag and the rear borehole sealing airbag and faces the expansion airbag respectively.

Further, the other end of the pressure measuring tube is connected with a sieving tube and a plurality of sieve pores are opened on an end of the sieving tube.

Further, the end of the sieving tube is provided with a cone-shaped cap covering the sieve pores.

Further, a part that is on the pressure measuring tube and surrounded and wrapped by the expansion airbag is less in tube diameter than a part that is not surrounded and wrapped by the expansion airbag.

Further, the part that is on the pressure measuring tube and surrounded and wrapped by the expansion airbag is provided with a pressure introducing hole.

Further, a sealing gel body is formed by blending water glass gel and high water absorbent resin.

Further, one end of the pressure measuring tube is provided with a wooden stopper.

The present disclosure also provides a dynamically self-balancing pressurized borehole sealing method for coal seam gas pressure measurement. The method may be applied to the above dynamically self-balancing pressurized borehole sealing apparatus for coal seam gas pressure measurement and include the following steps.

At step 1, the expansion airbag is communicated with the pressure measuring tube through the pressure introducing hole, a baffle and the rear borehole sealing airbag are assembled on an inner side of the expansion airbag on the pressure measuring tube, and a baffle and the front borehole sealing airbag are assembled on an outer side of the expansion airbag on the pressure measuring tube, the front borehole sealing airbag and the rear borehole sealing airbag are connected to the inflating unit outside the borehole through the inflating pipe, the gel injection chamber is connected to the gel injecting unit outside the borehole through the gel injection pipe, one end of the pressure measuring tube is connected to the pressure measuring unit, the other end of the pressure measuring tube is connected with the sieving tube and the pressure measuring tube is placed in the borehole.

At step 2, the borehole is sealed by inflating the front borehole sealing airbag and the rear borehole sealing airbag with the inflating unit, where inflation pressures of the front borehole sealing airbag and the rear borehole sealing airbag are greater than an estimated gas pressure in the borehole; the sealing gel body is injected into the gel injection chamber with the gel injecting unit, where a gel injection pressure of injecting the sealing gel body is greater than the estimated gas pressure in the borehole.

At step 3, with increasing gas pressure in the borehole, a large quantity of gas surges into the pressure measuring tube continuously from the borehole, a part of gas enters the expansion airbag through the pressure introducing hole to expand the expansion airbag, the expansion airbag continuously squeezes the sealing gel body in the gel injection chamber due to its expansion so that the sealing gel body enters fracture-pores of coal rocks around the borehole, achieving dynamic pressurized sealing.

Further, a step 4 is included. At step 4, when the pressure measuring unit monitors no visible change of the gas pressure in the borehole, the sealing gel body is injected into the gel injection chamber again with the gel injecting unit, where the gel injection pressure is greater than the gas pressure in the borehole.

Compared with the prior art, a dynamically self-balancing pressurized borehole sealing apparatus and a method thereof for coal seam gas pressure measurement have the following features and advantages.

The dynamically self-balancing pressurized borehole sealing apparatus and the method thereof for coal seam gas pressure measurement can effectively improve the coal seam borehole sealing effect of coal seam gas pressure measurement, thereby accurately measuring the coal seam gas pressure; without using an external continuous pressure source, a borehole sealing effect that the sealing gel body may be squeezed into the fracture-pores of the coal rocks more forcefully with a larger gas pressure so that a better airtightness of the coal seam borehole is achieved, thereby realizing dynamic self-balancing is realized.

After the specific examples of the present disclosure are read in combination with accompanying drawings, the features and advantages of the present disclosure will become more apparent.

BRIEF DESCRIPTION OF THE DRAWINGS

To describe technical solutions of the examples of the present disclosure and the prior art more clearly, brief descriptions will be made below to the accompanying drawings required for descriptions of the examples and the prior art. Apparently, the accompanying drawings described below are merely some examples of the present disclosure. Other drawings may be obtained by those skilled in the art based on these drawings without paying creative labor.

Figure 1:
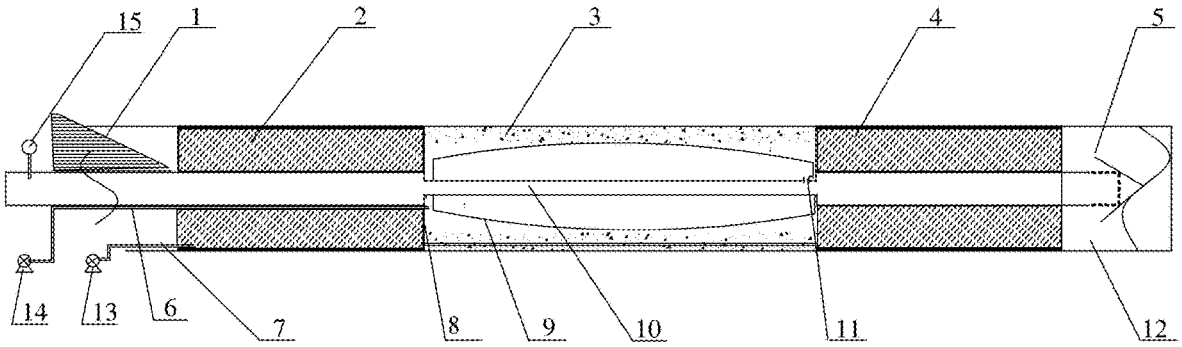
FIG. 1 is a schematic diagram illustrating a structure of a dynamically self-balancing pressurized borehole sealing apparatus for coal seam gas pressure measurement according to an example of the present disclosure.

In the drawings, 1 refers to a wooden stopper, 2 refers to a front borehole sealing airbag, 3 refers to a sealing gel body, 4 a rear borehole sealing airbag, 5 refers to a sieving tube, 6 refers to a gel injection pipe, 7 refers to an inflation pipe, 8 refers to a baffle, 9 refers to an expansion airbag, 10 refers to a pressure measuring tube, 11 refers to a pressure introducing hole, 12 refers to a borehole, 13 refers to an inflating pump, 14 is a gel injection pump, 15 refers to a pressure gauge, 16 refers to a fracture-pore, 17 refers to a coal rock.

DETAILED DESCRIPTION OF THE EMBODIMENTS

Figure 2:
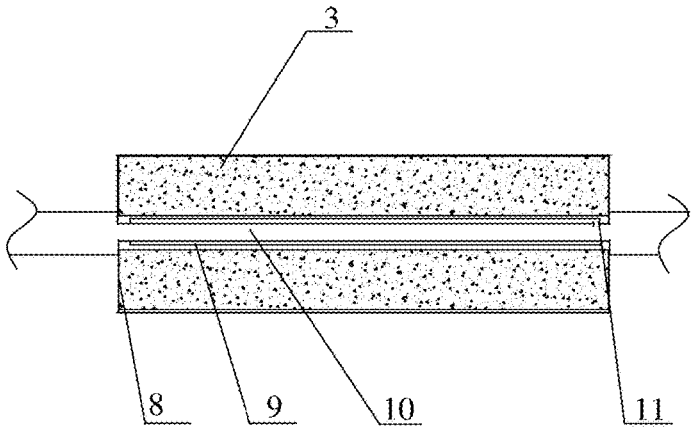
FIG. 2 is a schematic diagram illustrating a structure of an expansion airbag before pressurization in a dynamically self-balancing pressurized borehole sealing apparatus for coal seam gas pressure measurement according to an example of the present disclosure.
Figure 3:
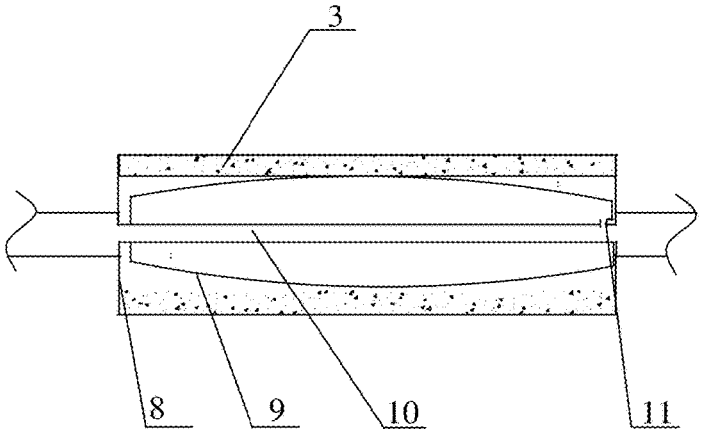
FIG. 3 is a schematic diagram illustrating a structure of an expansion airbag after pressurization in a dynamically self-balancing pressurized borehole sealing apparatus for coal seam gas pressure measurement according to an example of the present disclosure.
Figure 4:
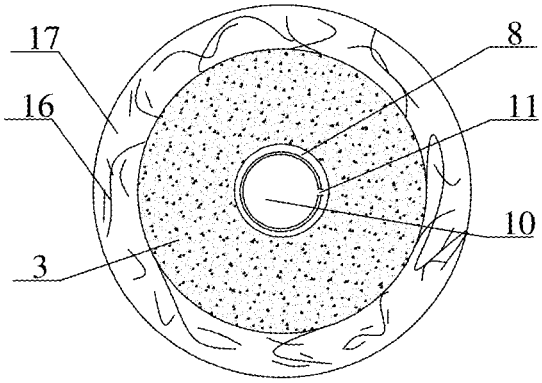
FIG. 4 is a section view of an expansion airbag before pressurization in a dynamically self-balancing pressurized borehole sealing apparatus for coal seam gas pressure measurement according to an example of the present disclosure.
Figure 5:
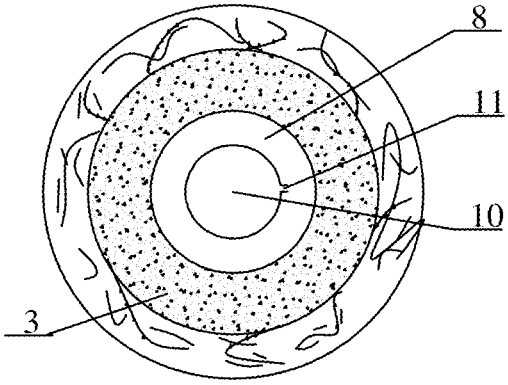
FIG. 5 is a section view of an expansion airbag after pressurization in a dynamically self-balancing pressurized borehole sealing apparatus for coal seam gas pressure measurement according to an example of the present disclosure.

As shown in FIGS. 1-5, a dynamically self-balancing pressurized borehole sealing apparatus for coal seam gas pressure measurement is provided in an example of the present disclosure. The apparatus includes a pressure measuring tube 10 arranged in a borehole 12, where one end of the pressure measuring tube 10 is provided with a pressure measuring unit, the pressure measuring unit in the example is a pressure gauge 15, and the pressure gauge 15 is used for measuring a gas pressure. One end of the pressure measuring tube 10 is also provided with a wooden stopper 1 to better fix the pressure measuring tube 10 at a mouth of the borehole 12. The other end of the pressure measuring tube 10 is connected with a sieving tube 5, a plurality of sieving pores are opened on an end of the sieving tube 5 to allow gas to enter, and the end of the sieving tube 5 is provided with a cone-shaped cap covering the sieving pores so that coal dusts are prevented from entering the sieving tube 5 when a gas pressure is measured.

An annular expansion airbag 9 is surrounded and wrapped on a borehole sealing segment of the pressure measuring tube 10, and the expansion airbag 9 is completely airtight, soft in texture and has expandable deformability. An inner diameter of the expansion airbag 9 is determined according to a tube diameter of the borehole sealing segment of the pressure measuring tube 10, the expansion airbag 9 is completely adhered to the borehole sealing segment of the pressure measuring tube 10, an outer diameter of the expansion airbag 9 is determined according to a hole diameter of the borehole 12 and usually is 0.8-1.2 times the hole diameter.

The pressure measuring tube 10 is provided with a pressure introducing hole 11 communicating with the expansion airbag 9 so that a part of gas released from a coal seam is introduced into the expansion airbag 9 through the pressure introducing hole 11. The pressure introducing hole 11 may communicate with the expansion airbag 9 through a gas transporting pipe. In the example, the pressure introducing hole 11 is opened on a part that is on the pressure measuring tube 10 and surrounded and wrapped by the expansion airbag 9 to realize communication of the pressure introducing hole 11 and the expansion airbag 9, simplifying a structure and avoiding gas leakage at a connection due to an insecure connection with the gas transporting pipe.

The pressure measuring tube 10 is a reducing tube and the tube diameter of the part that is on the pressure measuring tube 10 and surrounded and wrapped by the expansion airbag 9 is less than that of the part that is not surrounded and wrapped by the expansion airbag 9. The tube diameter of the part that is on the pressure measuring tube 10 and surrounded and wrapped by the expansion airbag 9 is ⅓ of the tube diameters of both ends. Both sides of the expansion airbag 9 on the pressure measuring tube 10 are surrounded and wrapped by an annular front borehole sealing airbag 2 and an annular rear borehole sealing airbag 4 respectively. The inner diameters of the front borehole sealing airbag 2 and the annular rear borehole sealing airbag 4 are determined according to a tube diameter of both sides of the borehole sealing segment of the pressure measuring tube 10, and outer diameters of the front borehole sealing airbag 2 and the annular rear borehole sealing airbag 4 are determined according to a hole diameter of the borehole 12, and usually are 0.8-1.0 times the hole diameter.

An annular baffle 8 surrounding the pressure measuring tube 10 is arranged on a side that is on the front borehole sealing airbag 2 and the rear borehole sealing airbag 4 and faces the expansion airbag 9 respectively. The front borehole sealing airbag 2 and the rear borehole sealing airbag 4 are fixed on both ends of the pressure measuring tube 10 through the baffle 8, and a sealing gel body 3 in a gel injection chamber will not be squeezed to the front borehole sealing airbag 2 and the rear borehole sealing airbag 4, thereby ensuring airtightness of the borehole 12. The gel injection chamber is reserved between the three of the front borehole sealing airbag 2 (or the baffle 8 at the position of the front borehole sealing airbag 2), the rear borehole sealing airbag 4 (or the baffle 8 at the position of rear borehole sealing airbag 4) and the expansion airbag 9 and an inner wall of the borehole 12 and the gel injection chamber is filled with the sealing gel body 3. The sealing gel body 3 is formed by blending water glass gel and high water absorbent resin and has particular fluidity and stickiness and its water retention can continue for more than one month in the coal seam environment. The front borehole sealing airbag 2 and the rear borehole sealing airbag 4 are connected to an inflating unit outside the borehole 12 through an inflating pipe 7 and the inflating unit in the example is an inflating pump 13. The gel injection chamber is connected to a gel injecting unit outside the borehole 12 through a gel injection pipe 6 and the gel injecting unit in the example is a gel injection pump 14.

A dynamically self-balancing pressurized borehole sealing method for coal seam gas pressure measurement is also provided in an example of the present disclosure. The method may be applied to the dynamically self-balancing pressurized borehole sealing apparatus for coal seam gas pressure measurement as above and may include the following steps.

At step 1, the expansion airbag 9 is communicated with the pressure measuring tube 10 through the pressure introducing hole 11, the baffle 8 and the rear borehole sealing airbag 4 are assembled at an inner side of the expansion airbag 9 on the pressure measuring tube 10, and the baffle 8 and the front borehole sealing airbag 2 are assembled at an outer side of the expansion airbag 9 on the pressure measuring tube 10, the front borehole sealing airbag 2 and the rear borehole sealing airbag 4 are connected to the inflating pump 13 outside the borehole 12 through the inflating pipe 7, the gel injection chamber is connected to the gel injection pump 14 outside the borehole through the gel injection pipe 6, one end of the pressure measuring tube 10 is connected with the pressure gauge 15, the other end of the pressure measuring tube 10 is connected to the sieving tube 5, the pressure measuring tube 10 is placed in the borehole 12 and one end of the pressure measuring tube 10 is snap-fitted with the wooden stopper 1.

At step 2, the borehole 12 is initially sealed by inflating the front borehole sealing airbag 2 and the rear borehole sealing airbag 4 with the inflating pump 13, the gel injection chamber between the three of the front borehole sealing airbag 2 (or the baffle 8 at the position of the front borehole sealing airbag 2), the rear borehole sealing airbag 4 (or the baffle 8 at the position of the rear borehole sealing airbag 4) and the expansion airbag 9 and an inner wall of the borehole 12 is also sealed into a closed space after the front borehole sealing airbag 2 and the rear borehole sealing airbag 4 are inflated, where the inflation pressures of the front borehole sealing airbag 2 and the rear borehole sealing airbag 4 are 0.5 MPa or more greater than an estimated gas pressure in the borehole 12; the gel injection chamber is injected with the sealing gel body 3 by the gel injection pump 14, the sealing gel body 3 completely squeezes the gas out of the expansion airbag 9 and a part of sealing gel body 3 is infiltrated into fracture-pores 16 of a coal rock 17, thereby realizing initial sealing of the borehole 12, where a gel injection pressure of injecting the sealing gel body 3 is 1 MPa or more greater than the estimated gas pressure in the borehole 12.

At step 3, along with increasing gas pressure in the borehole 12, a large quantity of gas continuously surges into the pressure measuring tube 10 from the borehole 12 and a part of gas enters the expansion airbag 9 through the pressure introducing hole 11 to expand the expansion airbag 9, the expansion airbag 9 continuously squeezes the sealing gel body 3 in the gel injection chamber due to its expansion to allow the sealing gel body 3 to slowly enter the fracture-pores 16 of the coal rocks 17 around the borehole 12. Thus, the gas in the region where the gas pressure is measured is prevented from leaking through the fracture-pores 16, thereby avoiding a lower measured gas pressure. As new fracture-pores 16 are formed continuously due to changes of the coal rocks 17, the sealing gel body 3 will be squeezed slowly into the new fracture-pores 16 again, realizing the purpose of dynamically pressurized sealing.

At step 4, when the pressure gauge 15 monitors no visible changes of the gas pressure in the borehole 12, the sealing gel body 3 is injected again into the gel injection chamber by the gel injection pump 14 with the gel injection pressure 1 MPa or more greater than the estimated gas pressure in the borehole 12 so that gas in the expansion airbag 9 is completely squeezed out to ensure that subsequent gas pressure continues to squeeze the sealing gel body 3 through the expansion airbag 9, thereby achieving a better dynamically pressurized sealing effect. When the gas pressure reaches a maximum value and will not change visibly, the most accurate coal seam gas pressure value can be measured by the pressure gauge 15.

The dynamically self-balancing pressurized borehole sealing apparatus and the method thereof for coal seam gas pressure measurement in the example effectively improve the sealing effect of the coal seam bore hole 12 for coal seam gas pressure measurement and obtains an accurate coal seam gas pressure; without using an external continuous pressure source, a borehole sealing effect that the sealing gel body 3 may be squeezed into the fracture-pores 16 of the coal rocks 17 more forcefully with a larger gas pressure so that a better airtightness of the coal seam borehole 12 is achieved, thereby realizing a dynamic self-balancing, is realized.

Of course, the above descriptions are not intended to limit the present disclosure and the present disclosure is not limited to the above examples. Any changes, modifications, addition or substitutions made by those skilled in the art within the substantial scope of the present disclosure shall all fall within the scope of the protection of the present disclosure.

The invention claimed is:

1. A dynamically self-balancing pressurized borehole sealing apparatus for coal seam gas pressure measurement, comprising a pressure measuring tube arranged in a borehole, wherein one end of the pressure measuring tube is provided with a pressure measuring unit for measuring a gas pressure, an expansion airbag is surrounded and wrapped on the pressure measuring tube, a pressure introducing hole is opened on the pressure measuring tube, the pressure introducing hole communicates with the expansion airbag and with gas from the coal seam, both sides of the expansion airbag on the pressure measuring tube are surrounded and wrapped with a front borehole sealing airbag and a rear borehole sealing airbag respectively, a gel injection chamber is reserved between the three of the front borehole sealing airbag, the rear borehole sealing airbag and the expansion airbag and an inner wall of the borehole, the gel injection chamber is filled with a sealing gel body, the front borehole sealing airbag and the rear borehole sealing airbag are connected to an inflating unit outside the borehole through an inflating pipe, and the gel injection chamber is connected to a gel injecting unit outside the borehole through a gel injection pipe, wherein, in response to receiving of the gas from the coal seam, the expansion airbag is configured to expand to squeeze the sealing gel body in the gel injection chamber to allow the sealing gel body to enter fracture-pores of a coal rock around the borehole, realizing dynamically pressurized sealing.

2. The dynamically self-balancing pressurized borehole sealing apparatus for coal seam gas pressure measurement according to claim 1, wherein a side that is on the front borehole sealing airbag and the rear borehole sealing airbag and faces the expansion airbag is provided with an annular baffle surrounding the pressure measuring tube respectively.

3. The dynamically self-balancing pressurized borehole sealing apparatus for coal seam gas pressure measurement according to claim 1, wherein the other end of the pressure measuring tube is connected with a sieving tube and a plurality of sieve pores are opened on an end of the sieving tube.

4. The dynamically self-balancing pressurized borehole sealing apparatus for coal seam gas pressure measurement according to claim 3, wherein an end of the sieving tube is provided with a cone-shaped cap covering the sieve pores.

5. The dynamically self-balancing pressurized borehole sealing apparatus for coal seam gas pressure measurement according to claim 1, wherein a tube diameter of a part that is on the pressure measuring tube and surrounded and wrapped by the expansion airbag is less than the tube diameter of a part that is not surrounded and wrapped by the expansion airbag.

6. The dynamically self-balancing pressurized borehole sealing apparatus for coal seam gas pressure measurement according to claim 1, wherein the part that is on the pressure measuring tube and surrounded and wrapped by the expansion airbag is provided with the pressure introducing hole.

7. The dynamically self-balancing pressurized borehole sealing apparatus for coal seam gas pressure measurement according to claim 1, wherein the sealing gel body is formed by blending water glass gel and high water absorbent resin.

8. The dynamically self-balancing pressurized borehole sealing apparatus for coal seam gas pressure measurement according to claim 1, wherein one end of the pressure measuring tube is provided with a wooden stopper.

9. A dynamically self-balancing pressurized borehole sealing method for coal seam gas pressure measurement, the method being applied to the dynamically self-balancing pressurized borehole sealing apparatus for coal seam gas pressure measurement according to claim 1, and comprising:

at step 1, communicating an expansion airbag with a pressure measuring tube through a pressure introducing hole, assembling a first baffle and a rear borehole sealing airbag at an inner side of the expansion airbag on the pressure measuring tube, assembling a second baffle and a front borehole sealing airbag at an outer side of the expansion airbag on the pressure measuring tube, connecting the front borehole sealing airbag and the rear borehole sealing airbag to an inflating unit outside a borehole through an inflating pipe, connecting a gel injection chamber to a gel injecting unit outside the borehole through a gel injection pipe, connecting one end of the pressure measuring tube to a pressure measuring unit and the other end of the pressure measuring tube to a sieving tube and placing the pressure measuring tube in the borehole;

at step 2, performing sealing for the borehole by inflating the front borehole sealing airbag and the rear borehole sealing airbag with the inflating unit, wherein inflation pressures of the front borehole sealing airbag and the rear borehole sealing airbag are greater than an estimated gas pressure in the borehole; and injecting the sealing gel body into the gel injection chamber by the gel injecting unit, wherein a gel injection pressure of injecting the sealing gel body is greater than the estimated gas pressure in the borehole; and at step 3, along with increasing gas pressure in the borehole, a predetermined amount of gas surges into the pressure measuring tube from the borehole, a part of the predetermined amount of gas enters the expansion airbag through the pressure introducing hole to expand the expansion airbag, and expansion of the expansion airbag continuously squeezes the sealing gel body in the gel injection chamber to allow the sealing gel body to enter fracture-pores of a coal rock around the borehole, realizing dynamically pressurized sealing.

10. The dynamically self-balancing pressurized borehole sealing method for coal seam gas pressure measurement according to claim 9, wherein a step 4 that the sealing gel body is injected again into the gel injection chamber by the gel injecting unit when the pressure measuring unit monitors no visible change of the gas pressure in the borehole, is further included, wherein the gel injection pressure is greater than the gas pressure in the borehole.

* * * * *